US006990786B2

(12) United States Patent
Kilmartin

(10) Patent No.: US 6,990,786 B2
(45) Date of Patent: Jan. 31, 2006

(54) WINE AND SPIRITS BOTTLE CARRY-OUT PACKAGE WITH ADVERTISING

(76) Inventor: Tracy Marie Kilmartin, 77 Ramapo Rd., Ridgefield, CT (US) 06877

( * ) Notice: Subject to any disclaimer, the term of this patent is extended or adjusted under 35 U.S.C. 154(b) by 0 days.

(21) Appl. No.: 10/820,274

(22) Filed: Apr. 8, 2004

(65) Prior Publication Data

US 2004/0216426 A1 Nov. 4, 2004

Related U.S. Application Data

(63) Continuation-in-part of application No. 10/025,738, filed on Dec. 19, 2001, now Pat. No. 6,718,733.

(51) Int. Cl.
*B65B 21/00* (2006.01)
*B65B 61/20* (2006.01)

(52) U.S. Cl. ..... 53/411; 53/445; 53/472; 53/474

(58) Field of Classification Search ..... 53/398, 53/410, 411, 445, 472, 474, 48.1–48.9, 49, 53/131.2–131.5, 139.5–139.7, 393, 390, 53/263, 246, 539, 156–158, 142–144; 206/427, 206/561, 459.5; 383/38; 493/391, 912, 493/91; 229/120.35, 120.36, 120.38, 120.07, 229/120.25; 40/312; 217/31, 34, 22
See application file for complete search history.

(56) References Cited

U.S. PATENT DOCUMENTS

| | | | | |
|---|---|---|---|---|
| 217,559 A | | 7/1879 | Swope | |
| 228,002 A | | 5/1880 | Swope | |
| 801,524 A | | 10/1905 | Hinde | |
| 1,473,313 A | | 11/1923 | Piatt | |
| 1,481,333 A | * | 1/1924 | Agar | 206/767 |
| 1,536,445 A | | 5/1925 | Maupai | |
| 1,632,347 A | | 6/1927 | Pipkin | |
| 1,847,277 A | | 3/1932 | Stephens | |
| 1,983,418 A | * | 12/1934 | Thurmer | 206/427 |
| 1,999,011 A | | 4/1935 | Wasser | |
| 2,081,409 A | | 5/1937 | Rush | |
| 2,089,297 A | * | 8/1937 | Read et al. | 383/38 |
| 2,132,236 A | | 10/1938 | Greene | 40/4 |
| 2,300,473 A | | 11/1942 | Van Winkle | |
| 2,341,570 A | | 2/1944 | Reachi | |
| 2,840,293 A | * | 6/1958 | Paige | 229/120.25 |
| 3,100,642 A | * | 8/1963 | Goldstein | 206/459.5 |
| 3,123,207 A | * | 3/1964 | Goldstein | 229/120.36 |
| 3,374,298 A | | 3/1968 | Studen | |
| 3,381,452 A | * | 5/1968 | Gentry et al. | 53/393 |
| 3,813,801 A | | 6/1974 | Vander Schaaf | |
| D254,226 S | | 2/1980 | Morse | D7/45 |
| 4,208,819 A | | 6/1980 | Jones et al. | 40/310 |

(Continued)

FOREIGN PATENT DOCUMENTS

GB 2213464 A * 8/1989

*Primary Examiner*—Stephen F. Gerrity
(74) *Attorney, Agent, or Firm*—St. Onge Steward Johnston & Reens LLC

(57) ABSTRACT

A method of advertising on wine and spirits bottles, which provides both advertising and a way to protect the bottles from damage in a shopping bag or box, in which bottle packaging dividers are imprinted with advertising material, and then distributed to retail sellers of wine and spirits so that employees may use the bottle packaging dividers to cushion the wine and spirit bottles sold by them to consumers, while at the same time providing an advertising vehicle.

21 Claims, 2 Drawing Sheets

U.S. PATENT DOCUMENTS 4,514,995 A 5/1985 Curtis et al.
4,869,599 A * 9/1989 Allen ..... 383/38
5,020,921 A * 6/1991 Beales ..... 383/38
5,102,036 A 4/1992 Orr et al.
5,289,650 A 3/1994 Follett et al. ..... 40/310
5,362,561 A 11/1994 Lower ..... 428/343
5,581,921 A 12/1996 Hutchens ..... 40/324
5,806,981 A * 9/1998 Schisler ..... 383/38
5,833,056 A * 11/1998 Goldman ..... 206/459.5
D403,209 S 12/1998 Zigterman ..... D7/625
6,293,405 B1 * 9/2001 Burch, Jr. ..... 206/427

* cited by examiner

WINE AND SPIRITS BOTTLE CARRY-OUT PACKAGE WITH ADVERTISING

PRIOR APPLICATIONS

This is a continuation in part of U.S. patent application Ser. No. 10/025,738 filed Dec. 19, 2001, which was issued on Apr. 13, 2004 as U.S. Pat. No. 6,718,733.

FIELD OF THE INVENTION

The present invention relates to a method and apparatus for placing advertising on wine and spirits bottles, which provides both advertising and a means to protect the bottles from damage in a shopping bag or box.

BACKGROUND OF THE INVENTION

The use of bottle advertisers has long been recognized. As a result, various inventions have been developed to effect this practice. Some of these include: U.S. Pat. No. 5,289,650 to Follett; U.S. Pat. No. 4,208,819 to Jones; U.S. Pat. No. 2,132,236 to Greene; U.S. Pat. No. 1,999,011 to Wasser; U.S. Pat. No. 1,536,445 to Maupai; and U.S. Pat. No. 1,473,313 to Piatt.

Prior art bottle advertisers have all been adapted for mounting on the bottle when it is stocked on a store shelf. Since these advertising devices are designed for mounting to a bottle prior to sale, they are limited in their advertising space because it is not desirable to obscure the label of the bottle with the advertising device. Therefore, these bottle advertisers are designed to fit on the neck of a bottle. Consequently, advertisers have a limited amount of space upon which to place advertising material. Efforts to increase the amount of advertising space have resulted in the invention of devices that are less easily manufactured or assembled, or which require more room for shipping or storage.

A more desirable bottle advertiser would be one that can be easily and quickly attached to a bottle at the point of sale. Since such an advertiser could be utilized after a consumer has purchased the bottle, and obscuring the label is therefore no longer of any concern, the advertiser can be designed to surround the base of the bottle. Such an advertiser would serve the purpose of providing more space upon which to place advertising material, but also serve the practical purpose of protecting bottles from one another, thereby preventing breakage, chafing, and noise, which can often result from the presence of multiple bottles in a single bag or box.

Accordingly, it is an object of the present invention to create a bottle advertiser that protects the bottle and provides more space upon which to place advertising material. It is a further object of the present invention to take advantage of the location of the bottle advertiser to also employ it as a device for protecting bottles from one another. Because such an advertiser may obscure labels on the bottle, it is yet another object of the present invention to create an advertiser that is easy to assemble or adjust to the size of the bottle at the point of sale of the bottle.

SUMMARY OF THE INVENTION

The invention also relates to a method of advertising comprising the steps of fabricating bottle packaging dividers that each have an exterior face, imprinting advertising information on the exterior faces, distributing the bottle dividers to retail outlets licensed to sell bottles of wine or liquor, or to merchandising companies, and employees of the retail outlets placing the bottle dividers between bottles of wine or liquor sold by the retail outlets at the time of packaging individual bottles for taking by a purchaser, or employees of merchandising companies placing the bottle dividers between bottles of wine or liquor when merchandising the bottles.

DETAILED DESCRIPTION OF THE INVENTION

The method of advertising of the invention using the bottle packaging divider described hereafter comprises the steps of: fabricating bottle dividers that have an exterior face and imprinting advertising information on the exterior faces. The bottle dividers are then distributed through distributors and mechandising companies, or directly, to retail outlets licensed to sell bottles of wine or liquor. Employees of the retail outlets then use the bottle dividers to separate bottles of wine or liquor sold by the retail outlets, typically at the time of packaging individual bottles for taking by a purchaser by placing the bottle dividers in bags or cartons used by the retail purchaser to take his purchase home. (In this application, the term "employees of the retail outlets" is intended to encompass all personnel working on site, and includes store employees, independent contractors, employees or independent contractors of merchandising companies, etc.).

In some cases, where display bottles may be displayed adjacent to or separately from inventory bottles, the bottle dividers may be pre-mounted to the inventory bottles where convenient and consistent with the product marketing at the particular retail outlet. In such cases, the mounting may be done at the retail outlet, or even by manufacturers or distributors, prior to delivery of the bottles to retail outlet. However, it is expected that this will not be the preferred method of the invention, as consumers typically prefer to select a bottle off the shelf without any cluttering packaging or information.

Figure 1:
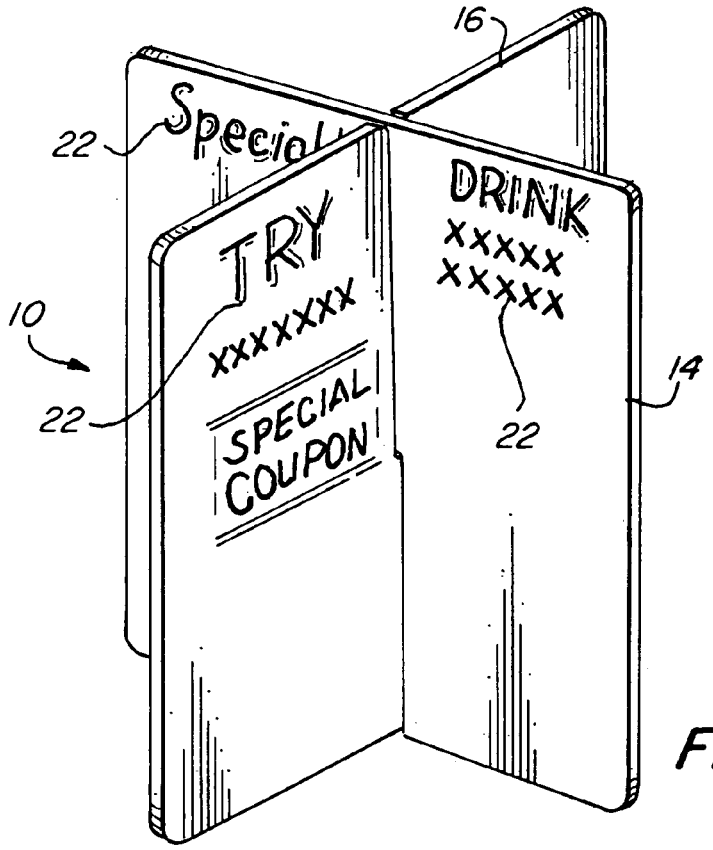
FIG. 1 is a perspective view of a bottle packaging divider having two sheets.
Figure 2:
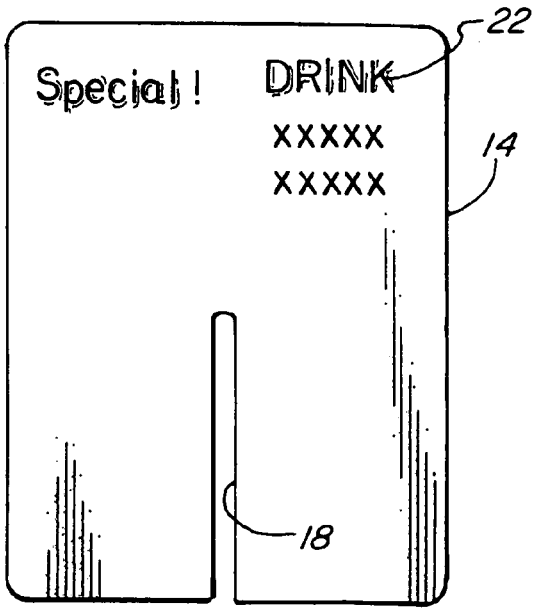
FIG. 2 is an elevation view of a first sheet of a bottle packaging divider.
Figure 3:
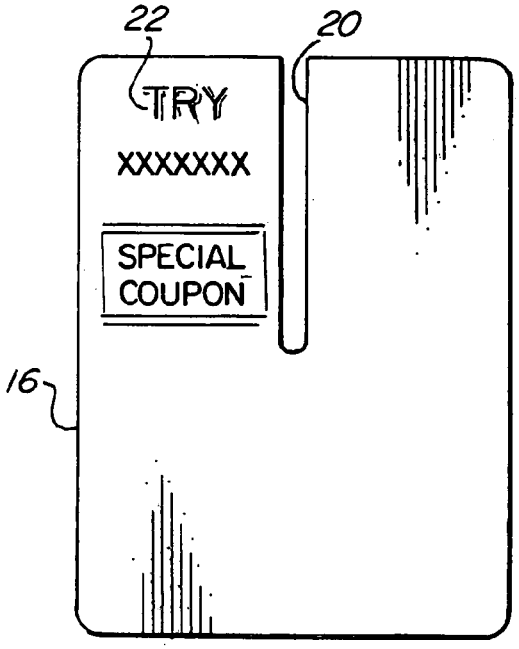
FIG. 3 is an elevation view of a second sheet of a bottle packaging divider.
Figure 4:
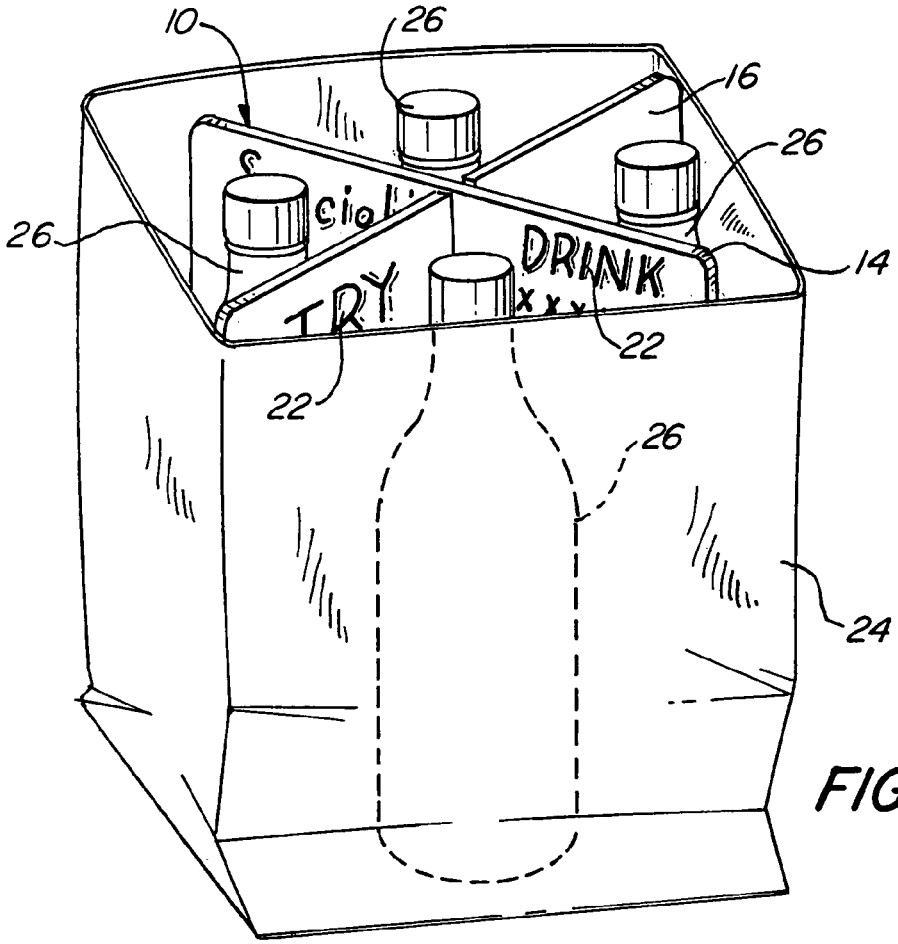
FIG. 4 is a perspective view of a bottle packaging divider as shown in FIG. 1, with a group of bottles, placed in a shopping bag.

Referring to FIGS. 1–4, a typical embodiment of the present invention takes the form of a bottle packaging divider 10 which comprises a cushioning material. The cushioning material comprises a corrugated paper or plastic material. The bottle packaging divider 10 is imprinted with advertising information 22. The bottle packaging divider 10 can constitute a single sheet 14 as shown in FIG. 2, but more typically, the bottle packaging divider 10 comprises at least two sheets 14 and 16 as shown in FIG. 1. Where there are two such sheets, either one or both such sheets may be imprinted with advertising information 22 on one or both sides. As seen in FIGS. 2 and 3, sheets 14 and 16 have slits 18 and 20 respectively cut therein. Sheets 14 and 16 may be mounted to each other by fitting together slits 18 and 20 of the two sheets to form a cross-shaped assembly. There are potentially eight (8) different advertising positions available on each face of the two sheets which are mounted together, though it is likely to be preferable to limit the number of advertisers to one, two or four advertisers. The sheets 14 and 16 are sized so that when they are mounted to each other they fit within a shopping bag 24 of a predetermined size, as shown in FIG. 4. The invention contemplates that the two sheets 14 and 16 will be mounted to each other by employees of the retail outlets using the bottle packaging dividers, then placed within bag 24 to separate bottles 26.

Figure 5:
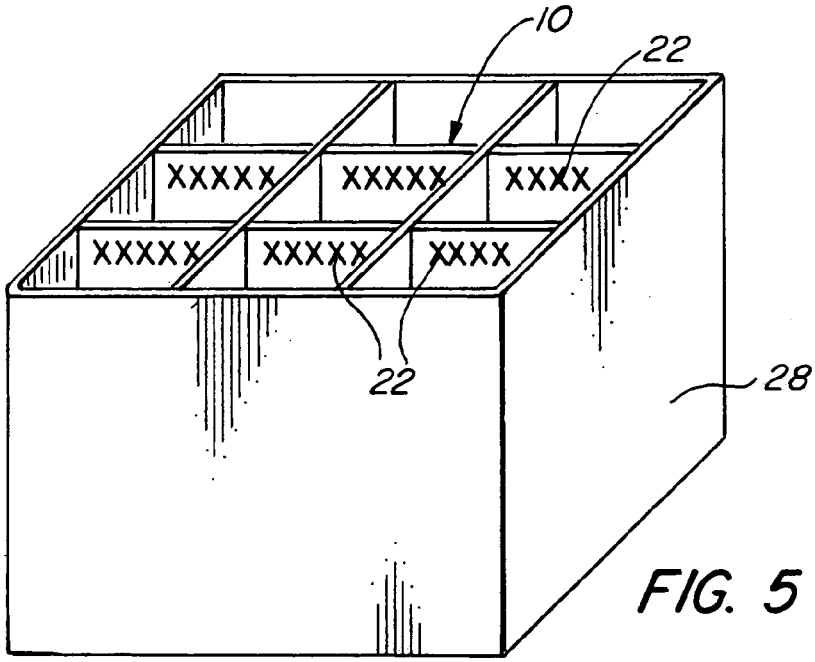
FIG. 5 is a perspective view of a bottle packaging divider placed in a carton.

In another embodiment, shown in FIG. 5, the bottle packaging divider may be used in a carton 28. A typical wine or spirits carton holds twelve bottles 26, requiring five or more sheets, and providing numerous potential advertising positions.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed is:

1. A method of advertising, comprising the steps of:

fabricating bottle packaging dividers each having a planar exterior face;

imprinting advertising information on the planar exterior faces of said bottle packaging dividers;

distributing said bottle dividers to retail outlets licensed to sell bottles of wine or liquor;

employees of said retail outlets placing said bottle packaging dividers between bottles of wine or liquor sold by said retail outlets, at the time of packaging individual bottles for taking by a purchaser of such bottles of wine or liquor with said advertising information positioned to be visible to said purchaser, and said dividers positioned to protect the bottles from damage.

2. A method in accordance with claim 1, wherein said bottle packaging dividers comprise a cushioning material.

3. A method in accordance with claim 2 wherein said cushioning material comprises a corrugated paper or plastic material.

4. A method in accordance with claim 1, wherein each said bottle packaging divider comprises at least two sheets, at least one sheet having advertising information imprinted thereon, each sheet having at least one slit cut therein, and said sheets are mounted to each other by fitting together slits of said sheets.

5. A method in accordance with claim 4, wherein said sheets are sized to fit within a shopping bag of a predetermined size.

6. A method in accordance with claim 4, wherein said sheets are sized to fit within a carton of a predetermined size.

7. A method in accordance with claim 4, wherein said sheets are mounted to each other by said employees of said retail outlets.

8. A method in accordance with claim 4, wherein there are two said sheets.

9. A method in accordance with claim 8, wherein said two sheets are both imprinted with advertising information.

10. A method of advertising, comprising the steps of:

fabricating bottle packaging dividers, each having a planar exterior face;

imprinting advertising information on the planar exterior faces of said bottle packaging dividers;

distributing said bottle dividers to manufacturers, distributors, or retailers of bottles of wine or liquor;

employees of said manufacturers, distributors, or retailers placing said bottle dividers between bottles of wine or liquor sold by said manufacturers, distributors, or retailers, either at the time of packaging individual bottles for taking by a purchaser of such bottles of wine or liquor or to bottles of wine or liquor held in inventory but not for display, with said advertising information positioned to be visible to said purchaser, and said dividers positioned to protect the bottles from damage.

11. A method in accordance with claim 10, wherein said bottle packaging dividers comprise a cushioning material.

12. A method in accordance with claim 11 wherein said cushioning material comprises a corrugated paper or plastic material.

13. A method in accordance with claim 10, wherein each said bottle packaging divider comprises at least two sheets, at least one sheet having advertising information imprinted thereon, each sheet having at least one slit cut therein, and said sheets are mounted to each other by fitting together slits of said sheets.

14. A method in accordance with claim 13, wherein said sheets are mounted to each other by said employees of said retail outlets.

15. A method in accordance with claim 13, wherein said sheets are sized to fit within a shopping bag of a predetermined size.

16. A method in accordance with claim 13, wherein said sheets are sized to fit within a carton of a predetermined size.

17. A method in accordance with claim 13, wherein there are two said sheets.

18. A method in accordance with claim 17, wherein said two sheets are both imprinted with advertising information.

19. A method in accordance with claim 10, wherein each said bottle packaging divider comprises at least three sheets, at least one sheet having advertising information imprinted thereon, each sheet having one or more slit cuts therein, and said sheets are mounted to each other by fitting together slits of said sheets, and wherein said sheets are sized to fit within a carton of a predetermined size.

20. A method in accordance with claim 19, wherein each sheet has two slit cuts therein, and said sheets are sized to fit within a carton having a size for receiving nine bottles of wine or liquor.

21. A method in accordance with claim 19, wherein each sheet has at least two slit cuts therein, and said sheets are sized to fit within a carton having a size for receiving twelve bottles of wine or liquor.

* * * * *